US006674226B2

(12) United States Patent
Meissner et al.

(10) Patent No.: US 6,674,226 B2
(45) Date of Patent: Jan. 6, 2004

(54) COLOR DISPLAY TUBE WITH IMPROVED SUSPENSION OF THE COLOR SELECTION ELECTRODE

(75) Inventors: Jörg Meissner, Eindhoven (NL); Jan Harmannus Post, Eindhoven (NL); Hernes Jacobs, Breda (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 155 days.

(21) Appl. No.: 09/853,938

(22) Filed: May 10, 2001

(65) Prior Publication Data

US 2002/0003393 A1 Jan. 10, 2002

(30) Foreign Application Priority Data

May 11, 2000 (EP) ..... 00201683

(51) Int. Cl.[7] ..... H01J 29/80

(52) U.S. Cl. ..... 313/404; 313/402; 313/407; 313/406

(58) Field of Search ..... 313/402, 404, 313/407, 406

(56) References Cited

U.S. PATENT DOCUMENTS 4,358,702 A * 11/1982 Gijrath et al. ..... 313/404
4,387,321 A 6/1983 Gijrath et al.
4,644,222 A * 2/1987 Brunn ..... 313/406
4,670,687 A * 6/1987 Gijrath et al. ..... 313/404
4,763,039 A 8/1988 Van Rens et al.
4,868,453 A * 9/1989 Van Rens et al. ..... 313/402
5,003,218 A * 3/1991 Gijrath et al. ..... 313/406

OTHER PUBLICATIONS

U.S. Application "Colourdisplay tube with improved suspension of the solour selection electrode", attorney docket No. PHNL 000235, filed May 1, 2001.
U.S. Application "Color display tube with improved suspension of the color selection electrode", attorney docket No. PHN 17,781, Ser. No. 09/722,814.

* cited by examiner

*Primary Examiner*—Nimeshkumar D. Patel
*Assistant Examiner*—Holly Harper

(57) ABSTRACT

A color display tube (1) is disclosed having an improved suspension system of the color selection electrode (12). The positional stability of the color selection electrode (12) is of eminent importance for the color purity of the color display tube (1). If the color selection electrode (12) slightly shifts, the electron beams (7,8,9) may impinge on electroluminescent material of the wrong color, leading to discolorations. It is recognized that this positional stability is improved by applying free end portions (22) of a smaller diameter on the supporting elements (17) because this will lower the friction between the free end portions (22) and the suspension means (20). This smaller diameter has the disadvantage that the insertion of the color selection electrode (12) into the display window (3) of the color display tube (1) becomes more difficult. This invention solves this problem by applying free end portions (22), which are provided with a centering tip (44). In order to prevent scratches—which lead to loose particles in the color display tube (1)—when the color selection electrode (12) is inserted or extracted, the free end portion (22) is smoothly shaped.

5 Claims, 7 Drawing Sheets

COLOR DISPLAY TUBE WITH IMPROVED SUSPENSION OF THE COLOR SELECTION ELECTRODE

TECHNICAL FIELD

The invention relates to a colour display tube comprising a display window with a circumferential upright edge and corner areas, a colour selection electrode comprising corner sections to which suspension means are coupled, which is suspended from supporting elements, having free end portions with an axis of symmetry, coupled to the corner areas. The invention also relates to a supporting element for use in a colour display tube.

BACKGROUND AND SUMMARY

A colour display tube as described in the opening paragraph is disclosed in U.S. Pat. No. 4,763,039. The colour display tube according to this specification is provided with a colour selection electrode, which is suspended in the corners of the display window. In this corner suspension system, the supporting elements, connected in the corners of the upright edge of the display window, are coupled to the suspension means of the colour selection electrode. The suspension means comprise a resilient element and a part with an aperture for receiving the spherically curved free end portion of the supporting elements.

The colour display tube described in U.S. Pat. No. 4,763,039 is provided with a colour selection electrode, to ensure that electron beams coming from three electron guns, mounted in a neck portion of the tube, only excite one colour of electroluminescent material on the inner side of the display window. This colour selection is achieved by applying, for instance, a shadow mask, comprising a large number of apertures, which are generally arranged in either a slotted pattern or a dotted pattern. If the colour selection electrode is not stably positioned in the colour display tube, small deviations of its position lead to a deterioration of the picture quality. When the colour selection electrode is shifted slightly, the shadowing effect of the colour selection electrode changes and, consequently, the electron beams do not hit the appropriate electroluminescent material on the display window. This misregistration causes a lack of the corresponding colour, or even worse, the wrong colour of electroluminescent material is excited. These misregistrations cause discolouration of the colour display tube that lead to a deterioration of the picture quality.

One of the items determining the stability of the colour selection electrode is the insertion process. It appears that positioning the colour selection electrode before it is inserted in the display window is a critical process. The ever increasing demand for a very accurately defined position of the colour selection electrodes, especially in wide screen tubes and in tubes with a flat or almost flat outer surface of the display window, causes the supporting elements as described in U.S. Pat. No. 4,763,039 to have the disadvantage that this demand is no longer met.

It is an object of the invention to provide a colour display tube with a colour selection electrode whose suspension system has been improved with respect to the type described in the opening paragraph, which strongly facilitates the insertion process of the colour selection electrode and thereby diminishes the registration errors on the display window.

According to the present invention, this object is achieved by means of a colour display tube, which is characterized in that each free end portion has a smoothly shaped centring tip in the direction of the axis of symmetry.

The invention is based on the insight that the insertion process of the colour selection electrode will gain in robustness when the free end portions of the supporting elements are provided with a centring tip. When the colour selection electrode is mounted in the display window, the free end portions are in general received by the apertured part of the suspension means. In order not to damage the colour selection electrode, and more particularly the suspension means, the colour selection electrode has to be positioned with great accuracy with respect to the free end portions of the supporting elements. This makes the insertion process very critical and in an appreciable number of cases the insertion process will fail. Applying a free end portion with a centring tip overcomes this disadvantage. The tip of the free end portion needed for finding its position in the apertured part of the suspension means is smaller than the diameter of the free end portions of prior art colour display tubes, thereby facilitating the insertion of the colour selection electrode into the display window.

The positional stability of the colour selection electrode is increased when the friction between the free end portion and the suspension means is reduced. This is achieved by decreasing the diameter of the free end portion, as is described in the unpublished European Patent Application EP 99203977.6. When the diameter of the free end portion becomes smaller, evidently also the aperture in the suspension means becomes smaller. This makes positioning of the colour selection electrode with respect to the supporting elements more difficult; this problem is solved by providing the free end portions with a centring tip.

Furthermore, it is of essential importance that the surface of the free end portion is smooth. Here, smooth has the meaning of mathematically differentiable; that is to say the surface has no sharp edges. For instance, in U.S. Pat. No. 4,387,321 a free end portion is disclosed that is shaped such that it can serve as a centring tip, but it does not have a smooth surface; its shape is conical with a flat end. A smoothly shaped free end portion has a number of advantages over the free end portions described in U.S. Pat. No. 4,387,321. Firstly, the centring properties are better because a smooth centring tip more easily slides into the aperture, whereas a centring tip with a flat end can collide with the edges of the aperture in the suspension means. Secondly, a smooth centring tip does not cause loose particles, while a centring tip with sharp edges easily scratches along the aperture of the suspension means during insertion of the colour selection electrode. Thirdly, the friction of a smooth centring tip in the aperture of the suspension means is lower, resulting in a better positional stability.

A preferred embodiment is characterized in that the free end portion further comprises a centre of gravity and a geometrical centre situated on the axis of symmetry at a larger distance from the upright edge than the centre of gravity. This means that, seen along the axis of symmetry, the geometrical centre is oriented more towards the end of the free end portion than the centre of gravity. So, the major part of the mass is directed away from the tip of the free end portion, which is a suitable situation for realizing a centring tip on the free end portion.

In a further embodiment, the free end portion is convex in shape. A convex free end portion is easy to manufacture and has a simple, smooth structure, which is very simple to centre in the aperture of the suspension means. It is to be noted that convex in this context means that the free end portion does not show any indentations; mathematically this means that it applies for any two points inside the free end portion, that also all the intermediate points on the line between said two points are inside the free end portion.

A still further embodiment is characterized in that the free end portion comprises a conical section which smoothly interconnects the substantially spherically shaped bottom part and the substantially spherically shaped centring tip, the radius of curvature of the centring tip being smaller than the radius of curvature of the base part. This shape of the free end portion has the advantage that a spherically shaped tip with a small radius of curvature is easy for centring purposes, while the bottom part is shaped so that the free end portion according to the present invention can easily be used instead of the spherically shaped free end portions according to prior art, often without changing the geometry of the apertures in the suspension means.

The invention also relates to a supporting element for use in a colour display tube according to the present invention.

BRIEF DESCRIPTION OF THE DRAWING FIGURES

These and other aspects of the invention will be apparent from and elucidated by way of non-limitative examples with reference to the drawings and the embodiments described hereinafter.

DETAILED DESCRIPTION

Figure 1:
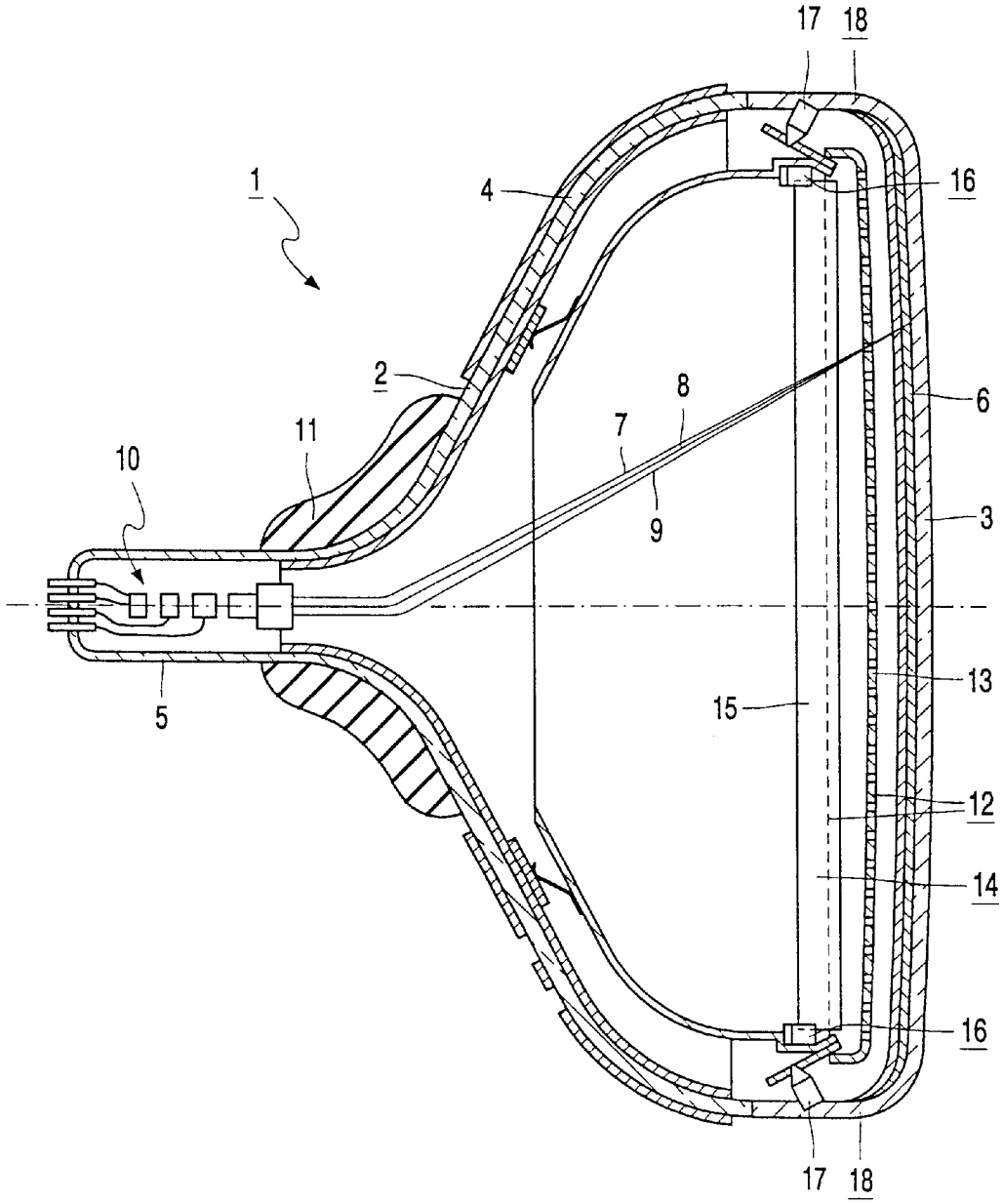
FIG. 1 is a sectional view of a colour display tube according to the invention.

The colour display tube 1 shown in FIG. 1 comprises an evacuated glass envelope 2 with a display window 3, a funnel shaped part 4 and a neck 5. On the inner side of the display window 3, a screen 6 having a pattern of for example lines or dots of phosphors luminescing in different colours (e.g. red, green and blue) may be arranged. The phosphor pattern is excited by the three electron beams 7, 8 and 9 that are generated by the electron gun 10. On their way to the screen, the electron beams 7, 8 and 9 are deflected by the deflection unit 11 ensuring that the electron beams 7, 8 and 9 systematically scan the screen 6. Before the electrons hit the screen 6 they pass through a colour selection electrode 12. This colour selection electrode 12 comprises a shadow mask 13, which is the real colour selection part: it intersects the electron beams so that the electrons only hit the phosphor of the appropriate colour. The shadow mask 13 may be a mask having circular or elongate apertures, or a wire mask. Further, the colour selection electrode 12 comprises the frame 14 for supporting the mask. Parts that can be distinguished in the frame 14 are, amongst others, the corner sections 16 and the diaphragm parts 15, interconnecting the corner sections 16.

The colour selection electrode 12 is suspended from the display window 3 by using supporting elements 17, which are secured in the upright edge of the corner areas 18 of the display window 3. This way of suspending the colour selection electrode 12 in a colour display tube 1 will further be referred to as corner suspension.

Figure 2:
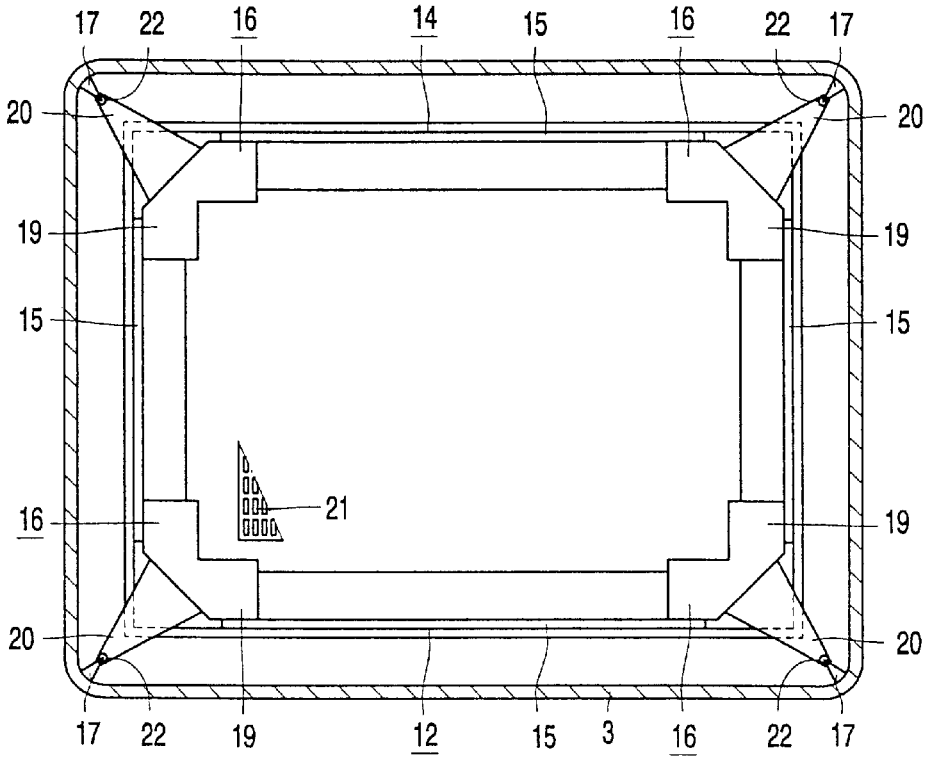
FIG. 2 is a schematic, elevational view of a colour selection electrode mounted in a display window.

In FIG. 2 a schematic, elevational view of a colour selection electrode 12 mounted in a display window 3 is given. The corner sections 16 in this Figure comprise two major portions, a rigid portion 19 for interconnecting the diaphragm parts 15 and a suspension element 20 for suspending the colour selection electrode 12 from the supporting elements 17 in the display window 3. The shadow mask 13 is coupled to the diaphragm parts 15. The section 21 of the mask as indicated in FIG. 2 serves only as an example.

During the manufacturing process, the colour selection electrode 12 has to be inserted into and extracted from the display window 3 several times, amongst others for the processes wherein the matrix and phosphor layers are deposited. In order to fulfil the demands regarding the required accuracy of the matrix and phosphor patterns, it is necessary that the position of the colour selection electrode 12 can be reproduced very accurately when it is inserted again. This requires a high positional stability of the colour selection electrode 12 in the colour display tube 1. For that reason it is required that the insertion process is simple and reproducible.

Figure 3:
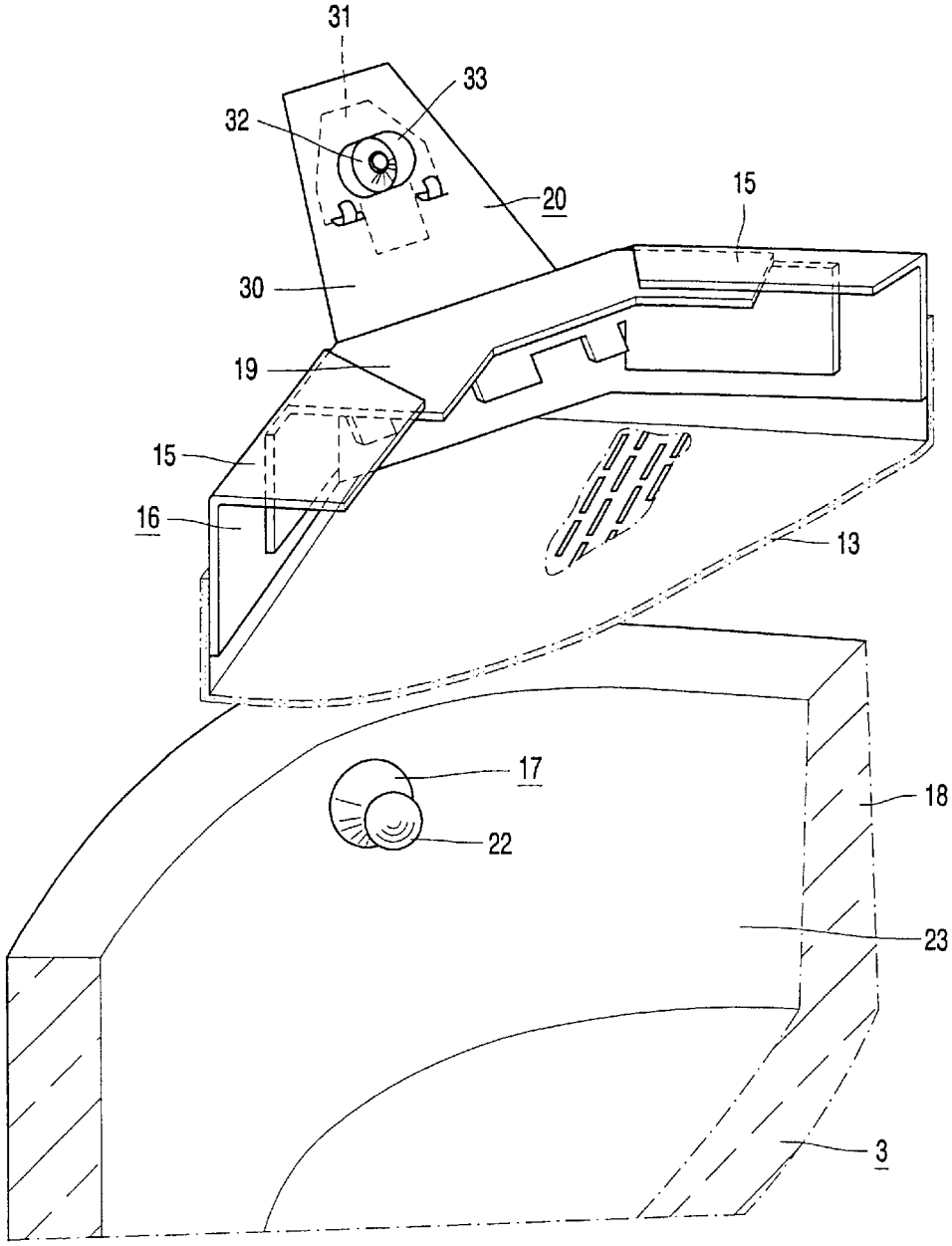
FIG. 3 is a perspective view of the corner area of the display window and the corner section of the colour selection electrode.

A detailed view of the corner area 18 of the display window 3 and the corner section 16 of the colour selection electrode 12 is given in FIG. 3. The suspension means 20 comprise a flat resilient element 30 to which a flat portion 31 is coupled. This flat portion 31 incorporates an apertured part 32 for engaging the free end portion 22 of the supporting element 17. By way of example, the free end portion 22 in this Figure is of the prior art type, that is to say it is spherical in shape. The flat portion 31 is positioned with respect to the resilient element 30 by the oblong aperture 33 in the resilient element 30 through which the apertured part 32 protrudes.

The suspension means 20 are designed to make sure that the colour selection electrode 12 is mounted in the display window 3 with a force that guarantees a reliable connection between the colour selection electrode 12 and the supporting elements 17.

Figure 4:
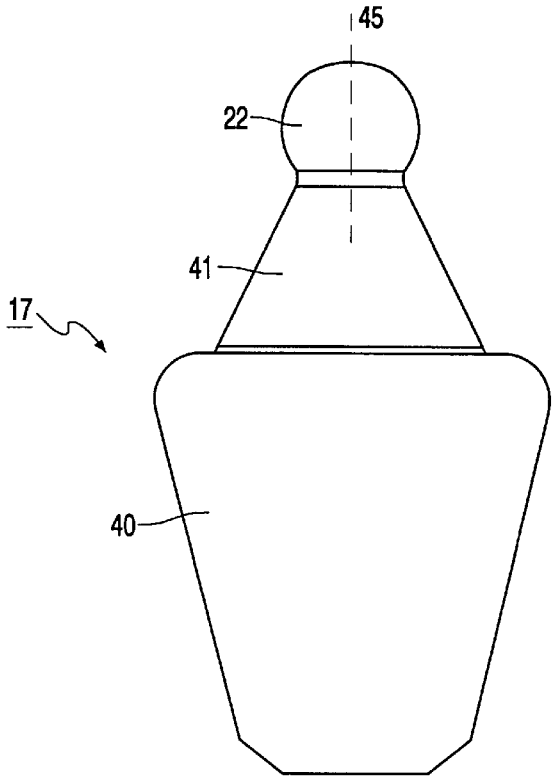
FIG. 4 PRIOR ART
FIG. 4 is a cross-section of a supporting element for use in a colour display tube according to the prior art.

FIG. 4 is a cross-section of a supporting element 17 for use in a colour display tube according to the prior art. The supporting element 17 comprises a base portion 40, a central portion 41—forming the connection between the base portion 40 and the free end portion 22—and the free end portion 22. The base portion 40 is coupled to the upright edge 23 of the display window 3 mainly by thermocompression. The free end portion 22 is a substantially spherically shaped ball. In addition, the free end portion 22 has an axis of symmetry 45; it is to be noted that only the symmetry of the free end portion 22 is relevant, not that of the entire supporting element 17.

Figure 5:
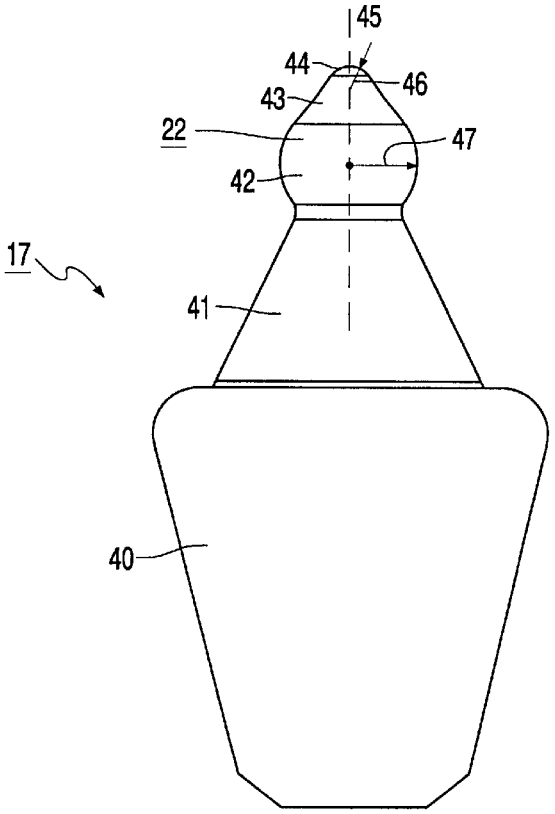
FIG. 5 is a cross-section of a supporting element for use in a colour display tube according to the invention.

FIG. 5 is an example of a supporting element 17 for use in a colour display tube 1 according to the present invention.

The free end portion 22 now comprises three sections. The bottom part 42 is a substantially spherically shaped section, which is smoothly connected to the also substantially spherically shaped centring tip 44 via a conical section 43. In order to make sure that a free end portion 22 with a centring tip 44 is created, it is necessary that the radius of curvature 46 of the centring tip 44 is smaller than the radius of curvature of the bottom part 42. The transitions between the conical section 43 and the spherically shaped sections 42 and 44 do not show any edges or kinks and hence are smooth by definition.

Figure 6A:
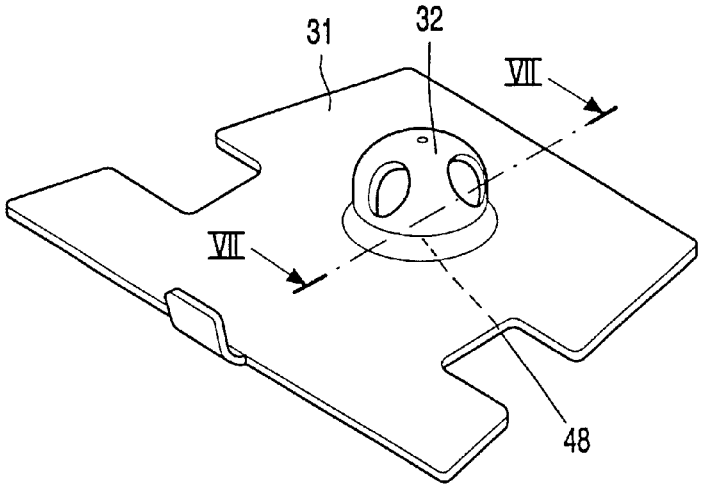
FIGS. 6A and 6B are flat portions with the apertured parts for receiving the free end portions.
Figure 6B:
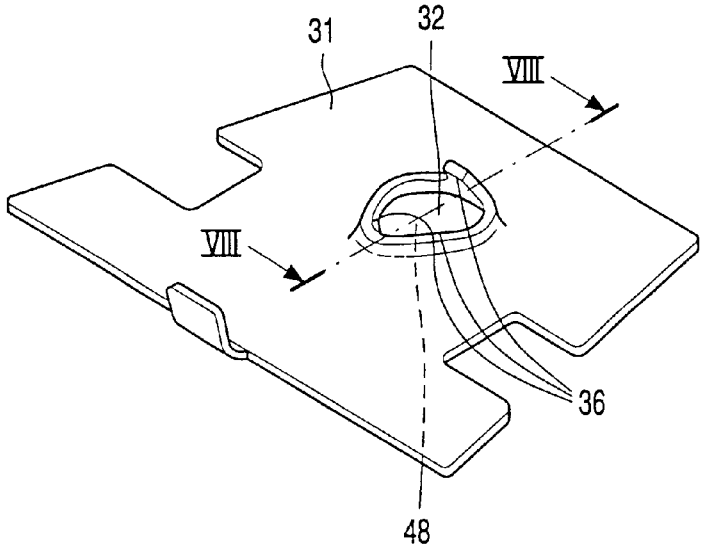

In FIG. 6 two examples of the flat portion 31 of the suspension means 20 are given. FIG. 6A gives a flat portion, as is currently used. The apertured part 32 is semi-dome shaped for receiving the substantially spherical free end portion 22. FIG. 6B is an alternative flat portion 31, provided with three surfaces of engagement 36 for contacting the free end portion 22. This construction enables a self-locking construction as is described in the unpublished European Patent Application with filing number 00201581.6 (PHNL000235). This application is incorporated herein by reference.

Figure 7A:
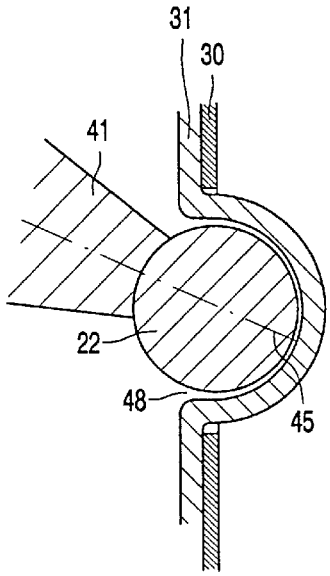
FIGS. 7A and 7B are cross-sections of a free end portion and the flat portion of FIG. 6A according to the prior art and according to the invention.
Figure 7B:
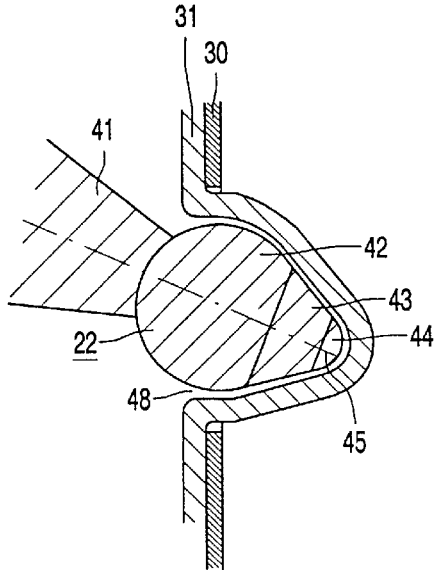

In FIG. 7, a cross section taken on the line VII—VII of FIG. 6A is given, showing the free end portion 22 as it is positioned in the apertured part 31. The prior-art situation is given in FIG. 7A, while in FIG. 7B a free end portion 22 according to the invention is used in combination with an adapted apertured part 31 for properly receiving said free end portion 22.

Figure 8A:
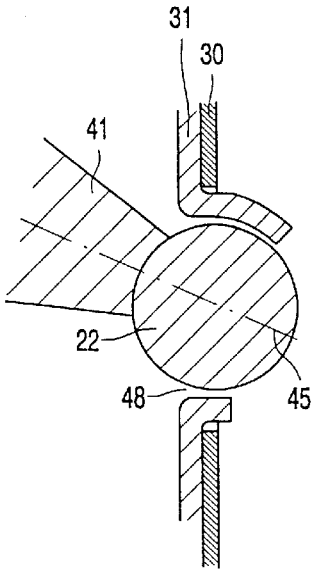
FIGS. 8A and 8B are cross-sections of a free end portion and the flat portion of FIG. 6B according to the prior art and according to the invention.
Figure 8B:
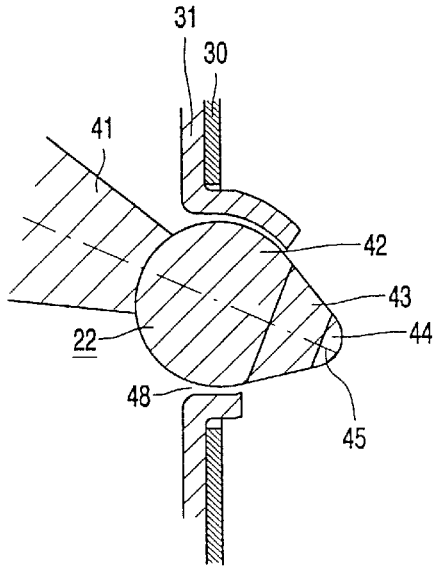

FIG. 8 are the corresponding Figures for the self-locking construction; a cross-section is taken on the line VIII—VIII in FIG. 6B. The prior-art free end portion 22 is shown in FIG. 8A and the free end portion 22 according to the invention in FIG. 8B.

Especially from the FIGS. 6, 7 and 8, it is clear that by providing the free end portion 22 with a centring tip 44, it becomes easier to insert the colour selection electrode 12 into the display window 3. During this insertion process, the four suspension means—one in each corner of the colour selection electrode 12—have to be simultaneously positioned with respect to the supporting elements 17. By having a centring tip 44 on the free end portions 22, it is easier for the entrance opening 48 of the apertured part to find the free end portion 22. During screen processing, i.e. the processes wherein, for instance, the black matrix and the phosphors are applied to the inside of the display window, the colour selection electrode 12 has to be inserted into and extracted from the display window 3 several times. It is important that this happens without scratching by the free end portions 22 and the suspension means 20. For that reason, the free end portions 22 are smoothly shaped.

Figure 9A:
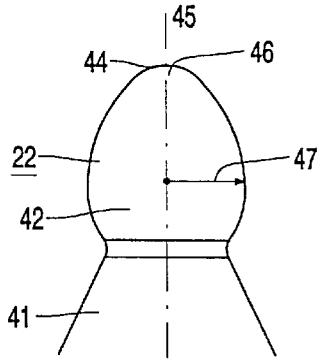
FIG. 9 are examples of alternative free end portions according to the invention.
Figure 9B:
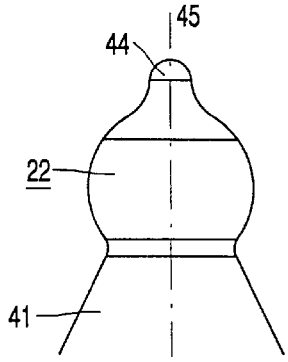
Figure 9C:
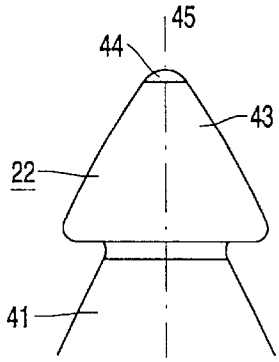
Figure 9D:
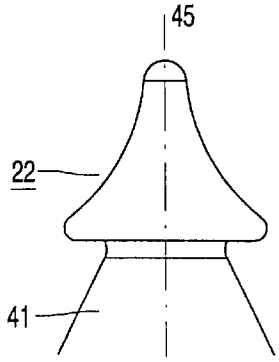

The invention is not limited to free end portions 22 provided with the shape given in FIG. 4. Within the framework of this invention, a lot of alternatives can be considered. FIG. 9 gives some examples of alternative free end portions 22 according to the present invention, which fulfil the most important demands, i.e. they have a centring tip and a smooth surface. FIG. 9A is an egg-shaped free end portion; its radius of curvature 46 at the centring tip 44 still is smaller than the radius of curvature 47 in the bottom part 42. FIG. 9B gives an example of a free end portion 22 which has a centring tip 44, which is smooth, but not convex in shape. In FIG. 9C, the conical section 43 has been extented in the direction of the central portion 41 leading to a more triangular cross-section of the free end portion 22. FIG. 9D is a kind of combination of the FIGS. 9B and 9C. If an alternative shape of the free end portion 22 is applied, this often implies an adaptation of the apertured part 32 in the flat portion 31.

In summary, a colour display tube 1 is disclosed having an improved suspension system of the colour selection electrode 12. The positional stability of the colour selection electrode 12 is of eminent importance for the colour purity of the colour display tube 1. If the colour selection electrode 12 slightly shifts, the electron beams 7,8,9 may impinge on electroluminescent material of the wrong colour, leading to discolourations. It is recognized that this positional stability is improved by applying free end portions 22 of a smaller diameter on the supporting elements 17, because this will lower the friction between the free end portions 22 and the suspension means 20. This smaller diameter has the disadvantage that the insertion of the colour selection electrode 12 into the display window 3 of the colour display tube 1 becomes more difficult. This invention solves this problem by applying free end portions (22), which are provided with a centring tip 44. In order to prevent scratches—which lead to loose particles in the colour display tube 1—when the colour selection electrode 12 is inserted or extracted, the free end portion 22 is smoothly shaped.

What is claimed is:

1. A colour display tube comprising a display window with a circumferential upright edge and corner areas, a colour selection electrode comprising corner sections to which suspension means are coupled, which is suspended from supporting elements, having free end portions with an axis of symmetry, coupled to the corner areas, characterized in that each free end portion has a smoothly shaped centring tip in the direction of the axis of symmetry, characterized in that the free end portion further comprises a centre of gravity and a geometrical centre situated on the axis of symmetry at a larger distance from the upright edge than the centre of gravity.

2. A colour display tube as claimed in claim 1, characterized in that the free end portion is convex in shape.

3. A colour display tube as claimed in claim 1, characterized in that the free end portion comprises a substantially spherically shaped bottom part and a substantially spherically shaped centring tip.

4. A colour display tube comprising a display window with a circumferential upright edge and corner areas, a colour selection electrode comprising corner sections to which suspension means are coupled, which is suspended from supporting elements, having free end portions with an axis of symmetry, coupled to the corner areas, each free end portion having a bottom part and a smoothly shaped centring tip in the direction of the axis of symmetry, the free end portion having a centre of gravity and a geometrical centre situated on the axis of symmetry at a larger distance from the upright edge than the centre of gravity, the free end portion comprises a substantially spherically shaped bottom part and a substantially spherically shaped centring tip, characterized in that the free end portion comprises a conical section which smoothly interconnects the substantially spherically shaped bottom part and the substantially spherically shaped centring tip, the radius of curvature of the centring tip being smaller than the radius of curvature of the base part.

5. A supporting element for use in a colour display tube according to claim 1.

* * * * *